United States Patent [19]

Wilson

[11] 4,252,396

[45] Feb. 24, 1981

[54] CONNECTOR WITH FLAT CABLE GUIDES

[75] Inventor: Albert H. Wilson, Los Angeles, Calif.

[73] Assignee: Thomas & Betts Corporation, Raritan, N.J.

[21] Appl. No.: 968,011

[22] Filed: Dec. 8, 1978

[51] Int. Cl.[3] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,355,699 | 11/1967 | Oshva | 339/99 R |
| 3,444,506 | 5/1969 | Wedekind | 339/99 R |
| 3,816,818 | 6/1974 | Meier | 339/99 R |
| 3,994,554 | 11/1976 | Navarro | 339/99 R |

FOREIGN PATENT DOCUMENTS

| | | | |
|---|---|---|---|
| 2361483 | 6/1974 | Fed. Rep. of Germany | 339/99 R |
| 7708720 | 2/1978 | Netherlands | 339/99 R |

*Primary Examiner*—Joseph H. McGlynn

*Attorney, Agent, or Firm*—James J. Daley; Robert M. Rodrick; Jesse Woldman

[57] ABSTRACT

A connector is disclosed which includes a base having a first and second surface and first and second rows of contacts, each having a conductor engaging portion upstanding from the aforementioned first surface. A cover is connected to the base and is movable between a first position in which clearance is provided between the conductor engaging portions of the contacts and the cover and a second position in which the conductors of a multiconductor cable inserted between the conductor engaging portions of the contacts and the cover are brought into electrical engagement with the conductor engaging portions of the contacts. Cable guide means are positioned between the first and second rows of contacts for guiding the multiconductor cable on its path of travel between the first and second rows of contacts. In an alternative embodiment, the cable guide means are temporarily inserted through the base to facilitate the insertion of the multiconductor cable through the connector and thereafter removed before the cover is moved to its second position.

12 Claims, 5 Drawing Figures

CONNECTOR WITH FLAT CABLE GUIDES

BACKGROUND OF THE INVENTION

This invention relates to connectors for making electrical contact with the individual conductors of a multiconductor cable, more particularly to such connectors commonly known in the industry as the one-piece type, and even more particularly to a technique for facilitating the insertion of multiconductor cables into such connectors.

BACKGROUND OF THE INVENTION

A connector for making electrical connection to the individual conductors of a multiconductor cable, sometimes commonly known as a ribbon cable or flat cable, generally comprises a base having first and second rows of electrical contacts supported therein. One portion of each of the contacts extends above the base and is intended to make electrical connection with a selected one of the individual conductors of the multiconductor cable. Most commonly, the conductor engaging portion of each contact is of the insulation displacing or piercing type, that is, including at least a pair of insulation piercing regions separated by a conductor receiving slot. The lower portion of each contact may be of any desired configuration, i.e., male or female, to facilitate electrical connection from a given device through the aforedescribed contact and ultimately to the selected conductor in the multiconductor cable.

Associated with the base is a cover. Customarily, the cover includes complementary recesses which receive the insulation piercing portions of the contacts when the cover is pressed toward the base to force the insulation piercing portions of the contacts through the multiconductor cable, at which time the individual conductors of the cable make electrical connection within the conductor receiving slot of the insulation displacing portion of the contacts.

In the multiconductor cable industry, there are generally two types of connectors of the aforedescribed type. The first is the so-called two piece construction where the base and cover are considered separate pieces. During assembly, the user places the multiconductor cable across the upper surface of the base in such a manner that the individual conductor regions of the multiconductor cable are properly aligned across the two rows of electrical contacts. Thereafter, the cover is placed over the multiconductor cable, and the sandwich formed thereby is compressed or crimped such that the insulation displacing portions of the contacts pass through the insulation of the cable into their respective recesses provided in the cover. The cover is provided with latching means which cooperates with the base to lock the cover in its fully compressed position at the completion of the crimping stroke.

The second type of connector prevalent in the industry is the so-called one piece construction in which the cover is preassembled to the base and is movable between a first position in which clearance is provided between the conductor engaging portions of the contacts and the cover and a second position in which the conductor engaging insulation piercing portions of the contacts pass through the multiconductor cable and into the recesses provided in the cover. Such one piece construction is illustrated, for example, in U.S. Pat. No. 4,006,957 issued to Ronald S. Narozny on Feb. 8, 1977, and assigned to the assignee of the present invention.

Although the so-called one piece construction in which the cover is preassembled to the base has the advantage of not requiring the ultimate user to assemble the cover to the base (as is the case with the two piece construction), the one piece connector has a disadvantage in that it is sometimes difficult to insert the multiconductor cable through the clearance space provided between the upper surfaces of the conductor engaging portions of the contacts and the undersurface of the cover when the cover is in its first prelatched position. The problem becomes especially acute when the two rows of contacts carried by the base are spread relatively far apart. In that situation, and especially when the multiconductor cable tends to curl, it is difficult to route the cable over the second row of contacts. Frequently, the user must remove the cable and straighten it out several times before he is able to thread the end of the multiconductor cable through the space provided between the second set of contacts and the undersurface of the cover.

SUMMARY OF THE INVENTION

To solve the aforementioned problem of facilitating the insertion of multiconductor cable through a one piece connector, the instant invention provides cable guide means positioned between the first and second rows of contacts for guiding the multiconductor cable on its path of travel through the clearance space between the first and second rows of contacts and the undersurface of the cover when the cover is in its prelatched, first position. In a preferred embodiment, the cable guide means comprises a plurality of guide rails upstanding from the upper surface of the base. Most advantageously, the guide rails are integrally provided on the base, although in an alternative embodiment, the guide rails may be carried by a separate plate secured to the upper surface of the base. The upper edges of the guide rails are pointed to facilitate their passage through the multiconductor cable at portions of the insulation thereof intermediate adjacent conductors. The cover includes slots to receive the guide rails in a manner analogous to the recesses in the cover which receive the conductor engaging insulation piercing portions of the contacts when the cover is moved from its first position to its second position during which time electrical connection to the cable conductors is established.

A first group of the guide rails includes a transition region starting from the upper surface of the base up toward a first row of the contacts, and a second group of guide rails includes a transition region starting from the upper surface of the base up toward the second row of contacts. In this manner, the cable can be inserted from either side of the base with a respective group of guide rails functioning to guide the cable over the adjacent row of contacts.

In an alternative embodiment of the present invention, the base does not include the guide rails provided thereon. Rather, the base is provided with a plurality of slots elongated in a direction which traverses the distance between the first and second rows of contacts. During the insertion process, cables guides carried on a tool are inserted through the base until the upper regions thereof extend beyond the upper surface of the base. While the cable guides remain in position, the cable may be easily guided across the first and second rows of contacts. Thereafter, the cable guides are removed, and the cover moved from its first position to its second position to cause the insulation piercing portions of the contacts to pierce the cable and make electrical connection with the conductors embedded therein.

Accordingly, it is an object of the instant invention to provide cable guide means for use in a two piece connector to facilitate the insertion of a multiconductor cable through the base and cover thereof.

Another object of the instant invention is to provide such cable guide means which take the form of a plurality of cable guide rails upstanding from the upper surface of the base.

Still another object of the instant invention is to provide such cable guide rails which are pointed along the upper edges thereof to facilitate the passing of such rails through the insulation of the multiconductor cable.

Yet another object of the instant invention is to provide such cable guide rails which include transition regions which help guide a curled multiconductor cable up over a second row of contacts on the path of travel of said multiconductor cable through the clearance space provided between the contacts and the undersurface of the cover.

Yet another object of the instant invention is to provide such cable guide means in the form of cable guide rails which are temporarily inserted through the base of a connector during the time that a multiconductor cable is inserted between the upper ends of the contacts carried by the base and the undersurface of the cover preassembled thereto.

Other objects of the instant invention may be had by referring to the following specification and drawings.

DESCRIPTION OF THE PREFERRED EMBODIMENTS

Figure 1:
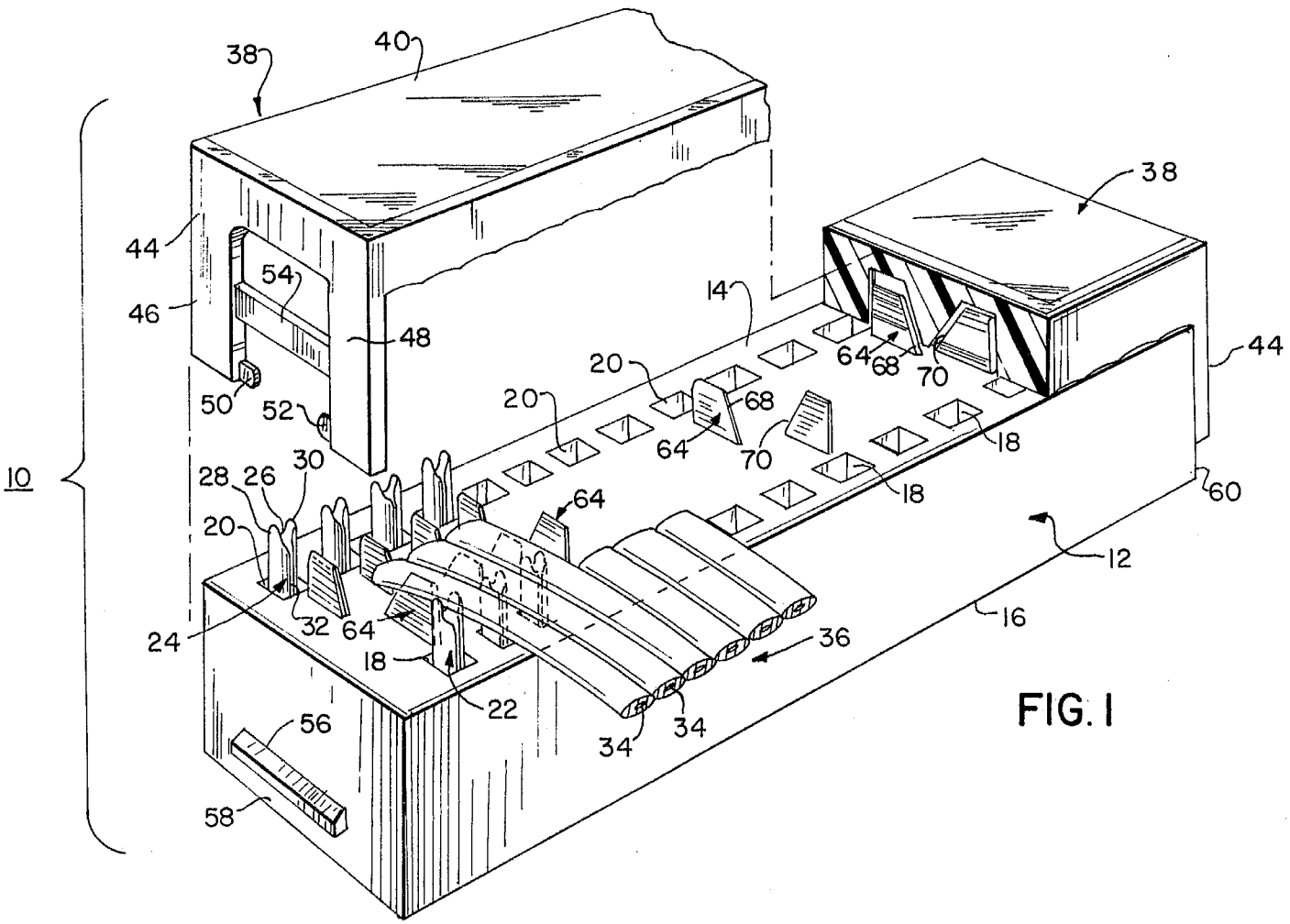
FIG. 1 is an exploded perspective view of a connector constructed in accordance with the teachings of the present invention.

In FIG. 1 is illustrated a connector 10 constructed in accordance with the instant invention. The connector 10 includes a base 12 having a first or upper surface 14 and a second or lower surface 16. Provided along opposite sides of the base are first and second rows of apertures 18 and 20, respectively, it being noted that each of the apertures 18 are laterally offset with respect to an associated aperture 20 as is conventional in such connector devices.

Positioned in the apertures 18 and 20 are rows of contacts 22 and 24, respectively. Although not intended to be limited to such construction, it may be noted that the contacts 22 and 24 may be of the type disclosed in greater detail in the aforementioned Narozny U.S. Pat. No. 4,006,957 and designated by the assignee of the present invention as the "Tulip" contacts. Thus, each of the contacts includes a conductor engaging portion 26 comprising at least two insulation piercing regions 28 and 30, separated by conductor receiving slots 32. The other end of each contact extends through the base toward the undersurface 16 thereof and may terminate in any desired configuration, i.e., male, female, friction tail, etc., to facilitate electroconnection of other devices (not shown) to the contact, and ultimately to the conductors 34 of the multiconductor cable 36.

Figure 2:
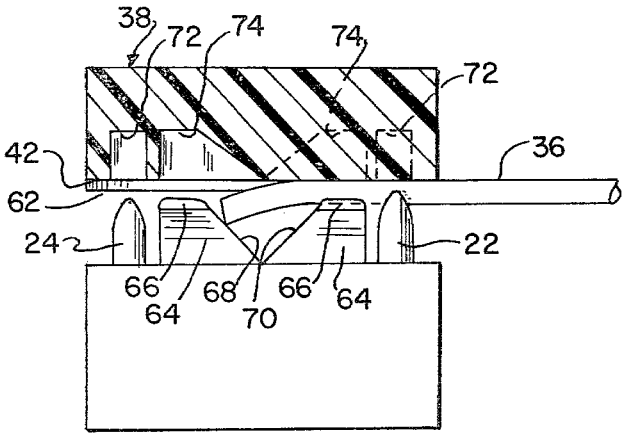
FIG. 2 is a side view, partly in section, of the connector of FIG. 1 illustrating the cover in its preassembled first position providing clearance between the undersurface of the cover and the upper extremities of contacts carried by the base and further illustrating the insertion of multiconductor cable through such clearance.

A cover 38 includes an upper surface 40 and an undersurface 42. Opposite ends of the cover 38 are provided with downwardly depending, generally A-shaped arm portions 44, the legs 46 and 48 of which are provided with inwardly turned latching tabs 50 and 52, respectively, and a latching center bar 54. As the connector is preassembled at the factory, the cover is positioned such that the latching tabs 50 and 52 are latched under latching ribs 56 outstanding from opposite sides 58 and 60 of the base. The factory preassembled condition in which the cover is latched in a first position with clearance space 62 between the upper extremities of the contacts 22 and 24 and the undersurface 42 of the cover 38 is illustrated in FIG. 2 herein and also in FIGS. 5 and 6 of the aforementioned Narozny U.S. Pat. No. 4,006,957.

As illustrated in FIGS. 1 and 2, in order to establish electrical connection between the contacts 22 and 24 and the conductors 34 of the multiconductor cable 36, it is first necessary to insert the multiconductor cable 36 through the clearance space 62 and over the rows of contacts 22 and 24. As pointed out previously, prior to the instant invention, and especially in connectors in which the rows of contacts 22 and 24 are widely separated, it is difficult to thread a curling multiconductor cable 36 through the clearance space 62. To eliminate that problem, the instant invention provides cable guide means in the form of a plurality of cable guide rails 64 upstanding from the surface 14 of the base. Preferably, the guide rails 64 are molded integrally with the base, although the rail 64 may be provided on a separate plate affixed to the upper surface 14. The upper edges 66 (FIG. 2) of the guide rails 64 are pointed to facilitate piercing the insulation of the multiconductor cable 36. Forward transition regions 68 of each of the guide rails adjacent the row of contacts 24 are chamfered or rounded (or may be diagonally oriented) from the upper surface of the base up toward the upper extremity of the contacts 24. Forward transition regions 70 of a second group of guide rails adjacent the first row of contacts 22 are similarly rounded, chamfered (or diagonally oriented) from the upper surface of the base up toward the upper extremity of the contacts 22. In this manner, and as best illustrated in FIG. 2, no matter which way the cable 36 is inserted, the respective group of guide rails 64 will direct the downwardly curling cable 36 back up and over the second row of contacts.

Figure 3:
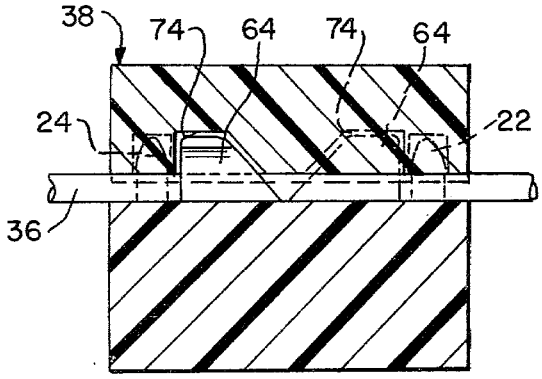
FIG. 3 shows a sectional side view of the connector of FIG. 1 with the multiconductor cable completely inserted therethrough and the cover in its second position, during which time the insulation displacing portions of the contacts and the guide rails of the present invention have pierced through the insulation of the multiconductor cable and into their respective recesses and slots provided in the undersurface of the cover.

As also seen in FIG. 2, cover 38 includes recesses 72 to receive the insulation piercing portions of the contacts 22 and 24 when the cover 38 is moved from its first latched position shown in FIG. 2 to its second closed position illustrated in FIG. 3. Also, the cover includes elongated slots 74 which, likewise, receive the guide rails 64 when the cover is moved from its first position shown in FIG. 2 to its second position illustrated in FIG. 3.

Assuming that multiconductor cable 36 has been inserted through the clearance space 62 between the contacts 22 and 24 and the undersurface of the cover 38 (with the aid of the guide rails 64 of the present invention), the cover is squeezed downwardly toward its second position illustrated in FIG. 3 and locked in that position by virtue of the crossbars 54 in the arms 44 of the cover sliding past and locking under the latching ribs 56 provided on opposite sides of the base. It is during the travel of the cover between its first and second position that the insulation piercing contacts 22 and 24 and the guide rails 64 pierce through the insulation of the multiconductor cable to be received by the recesses 72 and slots 74, respectively, while the individual conductors 34 are firmly grasped in the slots 32 established between the insulation piercing regions 28 and 30. It will be appreciated that not only do the guide rails 64 facilitate insertion of the cable 36 through the connector when the cover is in its first, latched position, but after complete assembly (FIG. 3) the guide rails 64 provide the connector with increased cable retention forces.

Figure 4:
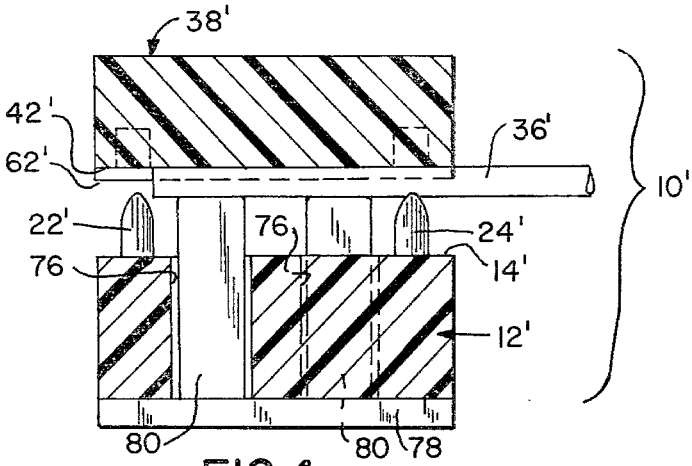
FIG. 4 illustrates a sectional side view of an alternative embodiment of the present invention and further illustrates the insertion process employed therewith.
Figure 5:
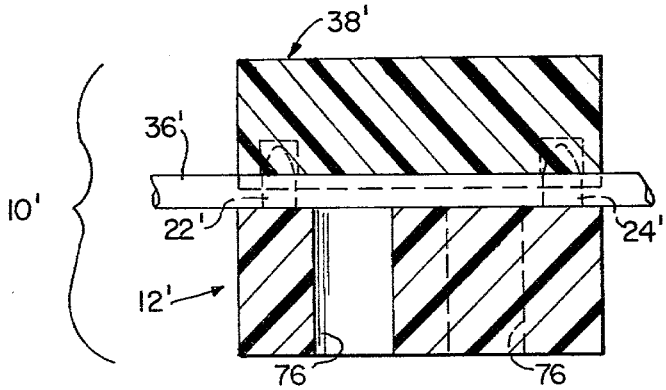
FIG. 5 illustrates in side sectional view the embodiment of FIG. 4 after the insertion process has been completed and the cover moved to its second position in which the insulation displacing portions of the contacts have passed through the multiconductor cable.

Turning to FIGS. 4 and 5, there is illustrated an alternative embodiment of the instant invention wherein primed numerals illustrate corresponding parts previously identified in FIGS. 1–3. The connector 10' includes a base 12' having rows of contacts 22' and 24' therealong. Disposed between the rows of contacts are elongated slots 76. When the cable 36' is about to be inserted in the clearance space 62' between the upper extremities of the contacts 22' and 24' and the undersurface 46' of the cover 38', a tool 78 carrying upstanding cable guide rails 80 is positioned beneath the base 12' with the cable guide rails 80 projecting through the slots 76 and beyond the upper surface 14' of the base. With the guide rails 80 so positioned, it is a simple matter to insert the cable 36' completely through the connector without any fear that the end of the cable 36' will curl down, making it difficult to thread the end of the cable over the second row of contacts. Once the cable is completely inserted through the connector, the tool 78 is removed and the cover 38' forced down to its second position, during which time the contacts 22' and 24' pierce the cable 36' in such a manner as to receive the individual conductors in the slots of the respective contacts (see FIG. 5).

Although this invention has been described with respect to its preferred embodiments, it should be understood that many variations and modifications will now be obvious to those skilled in the art, and it is preferred, therefore, that the scope of the invention be limited, not by the specific disclosure herein, but only by the appended claims.

What is claimed is:

1. A connector comprising:

a base having a first and second surface and first and second rows of insulation-piercing contacts, each having a conductor-engaging portion upstanding from said first surface;

a cover connected to said base, said cover movable between a first position in which clearance is provided between said conductor-engaging portions of said contacts and said cover and a second position in which the conductors of a multiconductor cable inserted between said conductor-engaging portions of said contacts and said cover are brought into electrical engagement with said conductor-engaging portions of said contacts; and cable guide means positioned between said first and second rows of contacts for guiding said multiconductor cable on its path of travel between said first and second rows of contacts, said cable guide means being electrically separate from said contacts and having insulation-piercing surface expanse for passage through said cable.

2. The connector of claim 1, wherein said conductor-engaging portions of each of said contacts include at least two insulation piercing regions separated by at least one conductor receiving slot, and said cover includes a plurality of recesses each of which is associated with one of said conductor-engaging portions and receives the insulation piercing regions thereof when said cover is moved from its first to its second position.

3. The connector of claim 2, wherein said cover is removably connected to said base.

4. The connector of claim 1, wherein said cable guide means comprises a plurality of guide rails upstanding from said first surface of said base.

5. The connector of claim 4, wherein said plurality of guide rails are integrally upstanding from said base.

6. The connector of claim 4, wherein said plurality of guide rails are carried on a plate secured to said first surface of said base.

7. The connector of claim 4, wherein the upper edge of each of said guide rails is pointed to facilitate passing through the insulation of said multiconductor cable.

8. The connector of claim 7, wherein said cover includes a plurality of slots to receive said guide rails.

9. The connector of claim 4, wherein each of a first group of said plurality of guide rails includes a transition region beginning from said first surface of said base up toward said first row of contacts.

10. The connector of claim 9, wherein each of a first group of said plurality of guide rails includes a curved region curving up from said first surface of said base toward said first row of contacts.

11. The connector of claim 9, wherein each of a second group of said plurality of guide rails includes a transition region beginning from said first surface of said base up toward said second row of contacts.

12. The connector of claim 11, wherein said first group of guide rails is laterally offset from said second set of guide rails.

* * * * *